US011211006B2

(12) United States Patent
Zhang et al.

(10) Patent No.: US 11,211,006 B2
(45) Date of Patent: Dec. 28, 2021

(54) DISPLAY DRIVER MODULE, DISPLAY APPARATUS, AND VOLTAGE ADJUSTMENT METHOD

(71) Applicants: ORDOS YUANSHENG OPTOELECTRONICS CO., LTD., Inner Mongolia (CN); BOE TECHNOLOGY GROUP CO., LTD., Beijing (CN)

(72) Inventors: Bo Zhang, Beijing (CN); Jingni Wang, Beijing (CN); Kun Guo, Beijing (CN)

(73) Assignees: ORDOS YUANSHENG OPTOELECTRONICS CO., LTD., Inner Mongolia (CN); BOE TECHNOLOGY GROUP CO., LTD., Beijing (CN)

( * ) Notice: Subject to any disclaimer, the term of this patent is extended or adjusted under 35 U.S.C. 154(b) by 6 days.

(21) Appl. No.: 16/474,949

(22) PCT Filed: Dec. 11, 2018

(86) PCT No.: PCT/CN2018/120303
§ 371 (c)(1),
(2) Date: Jun. 28, 2019

(87) PCT Pub. No.: WO2019/114697
PCT Pub. Date: Jun. 20, 2019

(65) Prior Publication Data

US 2019/0325828 A1 Oct. 24, 2019

(30) Foreign Application Priority Data

Dec. 12, 2017 (CN) ..... 201711317509.9

(51) Int. Cl.
*G09G 3/3258* (2016.01)

(52) U.S. Cl.
CPC ... *G09G 3/3258* (2013.01); *G09G 2320/0626* (2013.01); *G09G 2320/0666* (2013.01);
(Continued)

(58) Field of Classification Search
CPC ..... G09G 3/32; G09G 3/3208; G09G 3/3225; G09G 3/3258; G09G 2320/0276;
(Continued)

(56) References Cited

U.S. PATENT DOCUMENTS 7,889,157 B2 2/2011 Lee et al.
9,542,877 B2 1/2017 Park et al.
(Continued)

FOREIGN PATENT DOCUMENTS

CN 1753070 A 3/2006
CN 1825412 A 8/2006
(Continued)

OTHER PUBLICATIONS

International Search Report dated Feb. 27, 2019 corresponding to application No. PCT/CN2018/120303.
(Continued)

*Primary Examiner* — Stacy Khoo
(74) *Attorney, Agent, or Firm* — Nath, Goldberg & Meyer; Joshua B. Goldberg

(57) ABSTRACT

The present disclosure provides a display driver module, a display apparatus and a voltage adjustment method. The display driver module comprises a source driving unit and a power supply unit. The source driving unit is configured to generate a voltage control signal according to an acquired brightness control factor, the power supply unit is configured to adjust an operating voltage output to a cathode of a light emitting device according to the voltage control signal, the operating voltage decreases or maintains unchanged as display brightness corresponding to the brightness control
(Continued)

factor increases, and the operating voltage output by the power supply unit in response to the brightness control factor corresponding to minimum display brightness is greater than the operating voltage output by the power supply unit in response to the brightness control factor corresponding to maximum display brightness.

20 Claims, 4 Drawing Sheets

(52) U.S. Cl.
CPC ..... *G09G 2320/0673* (2013.01); *G09G 2330/021* (2013.01)

(58) Field of Classification Search
CPC ... G09G 2320/0626; G09G 2320/0666; G09G 2320/0673; G09G 2330/021; G09G 2330/028
See application file for complete search history.

(56) References Cited

U.S. PATENT DOCUMENTS

| | | | | |
|---|---|---|---|---|
| 10,089,927 | B2 | 10/2018 | Sarma et al. | |
| 10,269,286 | B2 | 4/2019 | Zhang et al. | |
| 10,607,543 | B2 | 3/2020 | Chaji | |
| 2004/0113923 | A1* | 6/2004 | Ha | G09G 3/3208 345/690 |
| 2006/0061526 | A1 | 3/2006 | Shirasaki et al. | |
| 2014/0063079 | A1* | 3/2014 | Lee | G09G 5/02 345/690 |
| 2015/0145898 | A1* | 5/2015 | Hwang | G09G 3/3614 345/690 |
| 2017/0124958 | A1* | 5/2017 | Pyo | G09G 3/3291 |
| 2018/0061311 | A1* | 3/2018 | Lin | G09G 3/3233 |
| 2018/0268759 | A1 | 9/2018 | Wang et al. | |
| 2019/0362679 | A1 | 11/2019 | Pyo et al. | |

FOREIGN PATENT DOCUMENTS

| | | | |
|---|---|---|---|
| CN | 101673511 | A | 3/2010 |
| CN | 104637435 | A | 5/2015 |
| CN | 104778918 | B | 7/2015 |
| CN | 105590587 | A | 5/2016 |
| CN | 105719597 | A | 6/2016 |
| CN | 105788514 | A | 7/2016 |
| CN | 105869575 | A | 8/2016 |
| CN | 106652905 | A | 5/2017 |
| CN | 106803418 | A | 6/2017 |
| KR | 20060051459 | A | 5/2006 |
| KR | 100685842 | B1 | 2/2007 |

OTHER PUBLICATIONS

First Office Action dated Apr. 26, 2020, for corresponding Chinese application 201711317509.9.

* cited by examiner

DISPLAY DRIVER MODULE, DISPLAY APPARATUS, AND VOLTAGE ADJUSTMENT METHOD

CROSS-REFERENCE TO RELATED APPLICATION

This is a National Phase Application filed under 35 U.S.C. 371 as a national stage of PCT/CN2018/120303, filed on Dec. 11, 2018, an application claiming the benefit of Chinese Application No. 201711317509.9, filed on Dec. 12, 2017, the content of each of which is hereby incorporated by reference in its entirety.

TECHNICAL FIELD

The present disclosure relates to the field of display technology, more particularly, to a display driver module, a display apparatus, and a voltage adjustment method.

BACKGROUND

A conventional display apparatus includes: a display driver module and a display substrate. The display driver module includes: a power supply unit and a source driving unit. The display substrate includes a plurality of display circuits arranged in an array, and the display circuit includes: a pixel driving circuit and a light emitting device, the pixel driving circuit is coupled to an anode of the light emitting device, and the source driving unit is configured to generate a data voltage corresponding to a gray level and output the data voltage to a corresponding data line.

During a display process, a power supply unit is configured to provide a positive operating voltage Vdd to the pixel driving circuit and a negative operating voltage Vss to a cathode of the light emitting device, the data line provides a data voltage Vdata to the pixel driving circuit, and the pixel driving circuit provides a driving current to the light emitting device under the action of the positive operating voltage Vdd, the negative operating voltage Vss and the data voltage Vdata to control the light emitting device to emit light.

In the related art, brightness of the light emitting device is generally changed by adjusting the data voltage Vdata while keeping the positive operating voltage Vdd and the negative operating voltage Vss output from the power supply unit unchanged.

SUMMARY

In an aspect, the present disclosure provides a display driver module, including:

a source driving unit, configured to generate a voltage control signal according to an acquired brightness control factor; and a power supply unit, configured to adjust an operating voltage output to a cathode of a light emitting device according to the voltage control signal; wherein the operating voltage decreases or maintains unchanged as display brightness corresponding to the brightness control factor increases, and the operating voltage output by the power supply unit in response to the brightness control factor corresponding to a minimum display brightness is greater than the operating voltage output by the power supply unit in response to the brightness control factor corresponding to a maximum display brightness.

In an embodiment, the display brightness of the light emitting device is divided into a plurality of brightness intervals, and the operating voltage varies as the brightness interval to which the display brightness corresponding to the brightness control factor belongs varies.

In an embodiment, the display driver module further includes:

a gray scale control unit, configured to output a gray scale control signal to the source driving unit;

a gamma voltage output unit, configured to provide a gamma reference voltage group to the source driving unit, the gamma reference voltage group including a plurality of gamma reference voltages; and the source driving unit performs voltage division on the gamma reference voltage in the gamma reference voltage group according to the gray scale control signal to generate a data voltage, and outputs the data voltage to a corresponding data line.

In an embodiment, the brightness control factor is the gray scale control signal.

In an embodiment, the brightness control factor is the gamma reference voltage group.

In an embodiment, the operating voltage gradually decreases as the display brightness corresponding to the brightness control factor increases.

In an embodiment, the display driver module further includes: a memory for storing correspondence relationship between the gray scale control signal, the voltage control signal, and the operating voltage, wherein:

the gray scale control unit is configured to output a gray scale control signal to the source driving unit according to a display gray scale;

the source driving unit is further configured to generate a voltage control signal according to the acquired gray scale control signal; and the power supply unit is configured to output an voltage according to the voltage control signal generated by the source driving unit.

In an embodiment, the display driver module further includes: a memory for storing correspondence relationship between the gamma reference voltage group, the voltage control signal, and the operating voltage, wherein:

the gamma voltage output unit pre-stores a plurality of gamma reference voltage groups;

the source driving unit is further configured to generate a voltage control signal according to the acquired gamma reference voltage group; and the power supply unit is configured to output an operating voltage according to the voltage control signal generated by the source driving unit.

In another aspect, the present disclosure also provides a display apparatus including: the display driver module as described above.

In an embodiment, the display apparatus further includes: a display substrate having a plurality of pixel regions arranged in an array, wherein the pixel region is provided with a pixel driving circuit and a light emitting device, the pixel driving circuit being coupled to an anode of the light emitting device;

when the display driver module is the above display driver module, cathodes of the light emitting devices in a same column are coupled to the power supply unit through a same signal line, and cathodes of the light emitting devices in different columns are coupled to the power supply unit through different signal lines.

In an embodiment, when the display driver module is the above display driver module, a plurality of gamma reference voltage groups are pre-stored in the gamma voltage output unit;

the display apparatus further includes:

an overall brightness adjustment unit, configured to output a gamma voltage control signal to the gamma voltage output unit according to an operation from a user; and the gamma voltage output unit is further configured to provide a corresponding gamma reference voltage group to the source driving unit according to the gamma voltage control signal provided by the overall brightness adjustment unit.

In an embodiment, the display apparatus further includes: a display substrate having a plurality of pixel regions arranged in an array, wherein the pixel region is provided with a pixel driving circuit and a light emitting device, and the pixel driving circuit is coupled to an anode of the light emitting device; and cathodes of the light emitting devices in a same column are coupled to the power supply unit through a same signal line, and cathodes of the light emitting devices in different columns are coupled to the power supply unit through a same signal line.

In still another aspect, the present disclosure further provides a voltage adjustment method, including:

generating, by a source driving unit, a voltage control signal according to an acquired brightness control factor; and adjusting, by a power supply unit, an operating voltage output to a cathode of a light emitting device according to the voltage control signal; wherein the operating voltage decreases or keeps unchanged as display brightness corresponding to the brightness control factor increases, and the operating voltage output by the power supply unit in response to the brightness control factor corresponding to minimum display brightness is greater than the operating voltage output by the power supply unit in response to the brightness control factor corresponding to maximum display brightness.

In an embodiment, the display brightness of the light emitting device is divided into a plurality of brightness intervals, and the operating voltage varies as the brightness interval to which the display brightness corresponding to the brightness control factor belongs varies.

In an embodiment, the voltage adjustment method further includes:

performing voltage division on a gamma reference voltage in a gamma reference voltage group provided by a gamma voltage output unit according to a gray scale control signal provided by a gray scale control unit to generate a data voltage and outputting the data voltage to a corresponding data line by the source driving unit.

In an embodiment, the brightness control factor is the gray scale control signal.

In an embodiment, the brightness control factor is the gamma reference voltage group.

In an embodiment, the voltage adjustment method includes:

outputting, by the gray scale control unit, a gray scale control signal to the source driving unit according to a display gray scale;

generating, by the source driving unit, a voltage control signal according to the acquired gray scale control signal; and outputting, by the power supply unit, an operating voltage according to the voltage control signal generated by the source driving unit, wherein correspondence relationship between the gray scale control signal, the voltage control signal, and the operating voltage is pre-stored in a memory.

In an embodiment, the voltage adjustment method includes:

pre-storing, by a gamma voltage output unit, a plurality of gamma reference voltage groups;

generating, by the source driving unit, a voltage control signal according to an acquired gamma reference voltage group;

outputting, by the power supply unit, an operating voltage according to the voltage control signal generated by the source driving unit, wherein correspondence relationship between the gamma reference voltage group, the voltage control signal, and the operating voltage is pre-stored in a memory.

DETAILED DESCRIPTION

In order to enable those skilled in the art to better understand the technical solutions of the present disclosure, a display driver module, a display apparatus and a voltage adjustment method according to the present disclosure are further described in detail below with reference to the accompanying drawings.

Changing brightness of a light emitting device by adjusting a data voltage Vdata may be specifically implemented using a method of changing the brightness of the light emitting device by adjusting a gray scale corresponding to the data voltage or adjusting a gamma reference voltage. However, in practical applications, the display apparatus using the above method has brightness that cannot reach a target value when displaying a white screen, and has a low contrast due to high brightness when displaying a black screen, resulting in poor display quality.

Figure 1:
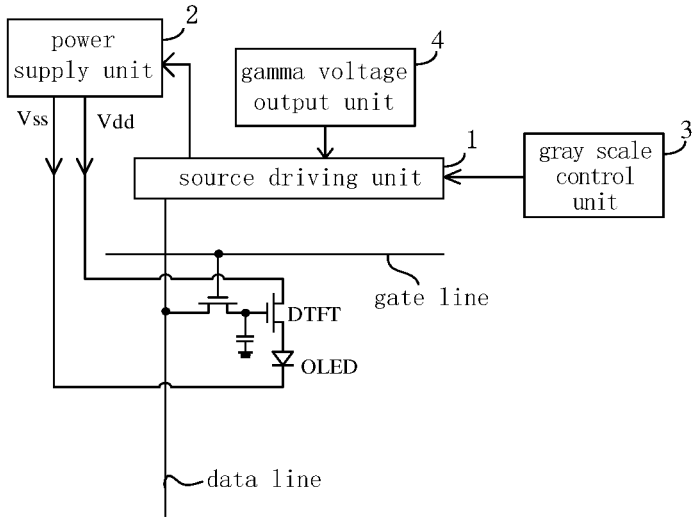
FIG. 1 is a schematic structural diagram of a display driver module according to an embodiment of the present disclosure.

For this purpose, the present disclosure, inter alia, provides a display driver module, a display apparatus, and a voltage adjustment method that substantially obviate one or more of the problems due to the limitations and disadvantages of the related art. FIG. 1 is a schematic structural diagram of a display driver module according to an embodiment of the present disclosure. As shown in FIG. 1, the display driver module includes: a source driving unit 1 and a power supply unit 2. The source driving unit 1 is configured to generate a voltage control signal according to an acquired brightness control factor; and the power supply unit 2 is configured to adjust a negative operating voltage output to a cathode of a light emitting device according to the voltage control signal. The negative operating voltage decreases or maintains unchanged as display brightness corresponding to the brightness control factor increases, and the negative operating voltage output by the power supply unit 2 when the brightness control factor corresponds to the minimum display brightness is greater than the negative operating voltage output by the power supply unit 2 when the brightness control factor corresponds to the maximum display brightness.

In the present disclosure, the light emitting device may be a current driving light-emitting device such as an LED (Light Emitting Diode) or an OLED (Organic Light Emitting Diode) in the prior art, and description is given in the embodiments of the present disclosure by taking an OLED as an example. The operating voltage output by the power supply unit 2 to the cathode of the OLED is a negative operating voltage Vss, which is typically a negative voltage.

It can be understood that a data signal of an image to be displayed can be converted to a data signal suitable for the source driving unit by, for example, a timing controller (TCON), and then supplied to the source driving unit 1, and the source driving unit 1 can output a corresponding data voltage (gray scale voltage) under the control of the timing controller. The data voltage is a factor that can determine the display brightness of the light emitting device OLED, and in other words, the display brightness of the light emitting device OLED can be controlled by controlling the magnitude of the data voltage. The "brightness control factor" in the present disclosure refers to a factor that can affect the magnitude of the data voltage output by the source driving unit 1. For example, the brightness control factor may be a gamma reference voltage group or a gray scale control signal, that is, the brightness control factor in the present disclosure may also be regarded as a factor that affects the display brightness of the light emitting device OLED.

In the present disclosure, the source driving unit 1 receives at least one brightness control factor, generates a corresponding data voltage according to the received brightness control factor, and outputs the data voltage to the corresponding data line. At the same time, the source driving unit 1 also generates a corresponding voltage control signal according to one selected brightness control factor, and sends the voltage control signal to the power supply unit 2, and the power supply unit 2 adjusts a negative operating voltage output to the cathode of the light emitting device OLED according to the received voltage control signal. The negative operating voltage decreases or keeps unchanged (monotonically decreases) as the display brightness corresponding to the brightness control factor increases, and the negative operating voltage output by the power supply unit 2 when the brightness control factor corresponds to the minimum display brightness is greater than the negative operating voltage output by the power supply unit 2 when the brightness control factor corresponds to the maximum display brightness. That is, when the light emitting device OLED displays a high brightness screen, the power supply unit 2 outputs a relatively low negative operating voltage; when the light emitting device OLED displays a low brightness screen, the power supply unit 2 outputs a relatively high negative operating voltage.

In the present disclosure, the display brightness may be divided into m brightness intervals (m is an integer greater than or equal to 2), brightness in the i-th interval is greater than brightness in the (i-1)-th interval (where i is an integer greater than 1 and less than or equal to m), and the negative operating voltage varies as the brightness interval to which the display brightness corresponding to the brightness control factor belongs varies. In other words, the negative operating voltage corresponding to the i-th interval is different from the negative operating voltage corresponding to the (i-1)-th interval. In addition, the negative operating voltage corresponding to the i-th interval is lower than the negative operating voltage corresponding to the (i-1)-th interval, and different brightnesses in a same interval correspond to a same negative operating voltage. In a case where the brightness control factor is a gamma reference voltage group, a plurality of gamma reference voltage groups may be set, different gamma reference voltage groups correspond to different brightness intervals, and accordingly correspond to different negative operating voltages. In a case where the brightness control factor is a gray scale control signal, the gray scale control signal may be divided into a plurality of intervals according to gray levels, and different intervals correspond to different brightness intervals, and accordingly correspond to different negative operating voltages.

Different from the related art, the technical solutions of the present disclosure can adjust the negative operating voltage output from the power supply unit 2 to the cathode of the light emitting device OLED according to the brightness control factor. In order that those skilled in the art can better understand the present disclosure, the principle of the present disclosure will be described in detail below with reference to the accompanying drawings.

Figure 2:
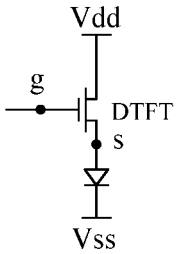
FIG. 2 is a circuit diagram showing a case where a driving transistor in a pixel driving circuit drives a light emitting device.

FIG. 2 is a schematic circuit diagram illustrating that a driving transistor in a pixel driving circuit drives a light emitting device. As shown in FIG. 2, it is assumed that a data voltage supplied from the source driving unit 1 is Vdata, and a gate g of the driving transistor DTFT has a voltage Vg during a display driving phase, and at this point, the negative operating voltage supplied from the power supply unit 2 to the cathode of the light emitting device OLED is Vss_1, the voltage Vs_1 of the source s of the driving transistor DTFT satisfies Vs_1=Vss_1+Voled_1, where Voled_1 is a voltage across the light emitting device OLED in an on state when the voltage of the cathode of the light emitting device OLED is equal to Vss_1 (Voled_1 is positively correlated with a current flowing through the light emitting device OLED).

According to the saturation region current formula for the driving transistor DTFT:

$$\begin{aligned} I_1 &= K*(Vgs - Vth)^2 \\ &= K*(Vg - Vs_1 - Vth)^2 \\ &= K*[Vg - (Vss_1 + Voled_1) - Vth]^2 \end{aligned}$$

where K is a constant (determined by the characteristics of the driving transistor DTFT), Vth is a threshold voltage of the driving transistor DTFT, and in a case where the data voltage supplied by the source driving unit 1 is unchanged, the negative operating voltage supplied by the power supply unit 2 to the cathode of the light emitting device OLED is decreased to Vss_2 lower than the original negative operating voltage Vss_1 (the absolute value of the negative operating voltage Vss_2 is greater than the absolute value of the negative operating voltage Vss_1).

Since the data voltage is not changed, the voltage of the gate g of the driving transistor DTFT is still Vg during the display driving phase; and since the negative operating voltage supplied from the power supply unit 2 to the cathode of the light emitting device OLED is decreased to Vss_2, the voltage Vs_2 of the source s of the driving transistor DTFT satisfies Vs_2=Vss_2+Voled_2, where Voled_2 is a voltage across the light emitting device OLED in an on state when the voltage of the cathode of the light emitting device OLED is equal to Vss_2.

According to the saturation region current formula for the driving transistor DTFT:

$$\begin{aligned} I_2 &= K*(Vgs-Vth)^2 \\ &= K*(Vg-Vs_2-Vth)^2 \\ &= K*[Vg-(Vss_2+Voled_2)-Vth]^2 \end{aligned}$$

it can be known that due to the decrease of the voltage of the cathode of the light emitting device OLED, the voltage of the anode of the light emitting device OLED is also decreased, that is, Vs_2<Vs_1, and since Vs_2=Vss_2+Voled_2 and Vs_1=Vss_1+Voled_1, it can be obtained that Voled_2+Vss_2<Voled_1+Vss_1, and at this time, $K*[Vg-(Vss_2+Voled_2)-Vth]^2>K*[Vg-(Vss_1+Voled_1)-Vth]^2$, i.e., I_2>I_1.

It should be noted that when the voltage of the cathode of the light emitting device OLED is decreased, the current flowing through the light emitting device OLED is increased, and the voltage across the light emitting device OLED in an on state is also increased (i.e., Voled_2>Voled_1). However, because the decrease amount of the voltage of the cathode (i.e., Vss_1−Vss_2) is larger than the increase amount of the voltage across the light emitting device OLED (i.e., Voled_2−Voled_1), Voled_2+Vss_2 is smaller than Voled_1+Vss_1.

It can be seen that, in the case of an unchanged data voltage, by reducing the voltage of the cathode of the light emitting device OLED, the driving current generated by the driving transistor DTFT can be increased, and the display brightness of the light emitting device OLED can be improved. Similarly, in the case of an unchanged data voltage, by increasing the voltage of the cathode of the light emitting device OLED, the driving current generated by the driving transistor DTFT can be decreased, and the display brightness of the light emitting device OLED can be reduced.

Based on the above principle, in a case where the light emitting device OLED displays a high brightness screen, a voltage control signal is output by the source driving unit 1 to the power supply unit 2 to control the power supply unit 2 to output a relatively low negative operating voltage (having a relatively large absolute value) to the cathode of the light emitting device OLED, so that the display brightness of the light emitting device OLED is further increased. In a case where the light emitting device OLED displays a low brightness screen, a voltage control signal is output by the source driving unit 1 to the power supply unit 2 to control the power supply unit 2 to output a relatively high negative operating voltage (having a relatively small absolute value) to the cathode of the light emitting device OLED, so that the display brightness of the light emitting device OLED is further decreased. Therefore, the technical solutions of the present disclosure can improve the brightness of the display apparatus when displaying a bright screen, and reduce the brightness of the display apparatus when displaying a dark screen, thereby improving the display effect.

Figure 3:
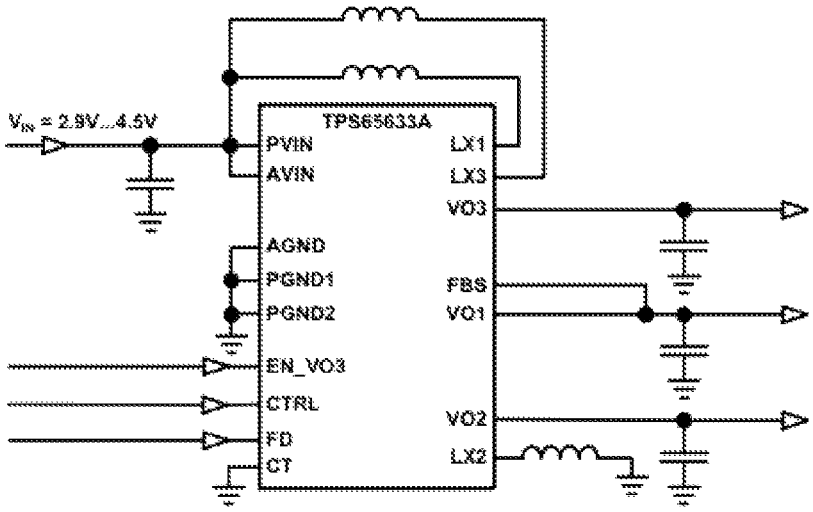
FIG. 3 is a schematic circuit diagram of a power supply unit of FIG. 1.
Figure 7:
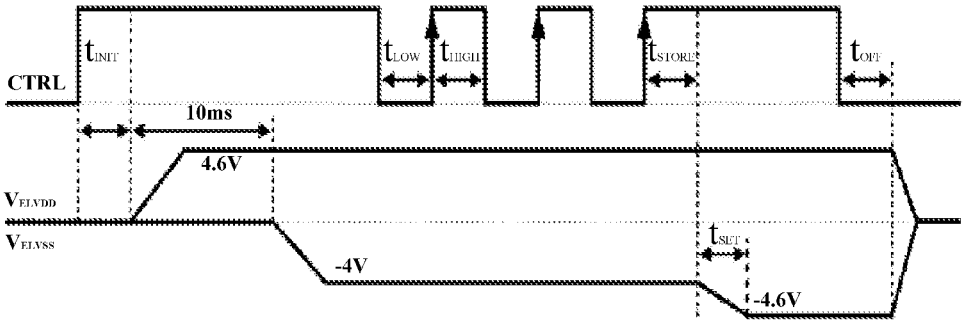
FIG. 7 is a schematic diagram illustrating principle of controlling a negative operating voltage to decrease through a voltage control signal in the power supply unit shown in FIG. 3.

FIG. 3 is a schematic circuit diagram of the power supply unit of FIG. 1. As shown in FIG. 3, the power supply unit 2 is a DC-DC power supply, and includes four input terminals of Vin terminal, EN_VO3 terminal, CTRL terminal, and FD terminal, and three outputs terminals of VO1 terminal, VO2 terminal and VO3 terminal. The Vin terminal is configured to supply an input voltage to the DC-DC power supply, the EN_VO3 terminal is configured to provide, for the DC-DC power supply, a control signal for controlling the output voltage of the VO3 terminal, and the CTRL terminal is configured to provide, for the DC-DC power supply, a control signal for controlling the output voltage of the VO1 terminal or the output voltage of the VO2 terminal, and the FD terminal is configured to control the DC-DC power supply to discharge; the VO1 terminal, the VO2 terminal, and the VO3 terminal are configured to output a positive operating voltage, a negative operating voltage and an analog voltage, respectively. In the present disclosure, the source driving unit 1 is coupled to the CTRL terminal of the DC-DC power supply and configured to provide a voltage control signal for controlling the magnitude of the negative operating voltage output from the VO2 terminal of the DC-DC power supply, and the principle of controlling by the CTRL terminal the negative operating voltage ELVSS to decrease may refer to FIG. 7. The DC-DC power supply is a common power source in the art, and its specific working process is not described in detail herein. It can be understood that the power supply unit 2 in the present disclosure is not limited to the power supply shown in FIG. 3, and any power source that can control the magnitude of the output negative operating voltage according to the voltage control signal provided by the source driving unit 1 may be used in the present disclosure.

In some embodiments, the negative operating voltage output from the power supply unit 2 to the cathode of the light emitting device OLED gradually decreases (i.e., strictly monotonically decreases) as the display brightness corresponding to the brightness control factor increases, and in this case, the brightness of the light emitting device OLED changes more evenly.

It should be noted that, in the present disclosure, it is only required that the negative operating voltage decreases or keeps unchanged (monotonically decreases) as the display brightness corresponding to the brightness control factor increases, and the negative operating voltage output by the power supply unit 2 when the brightness control factor corresponds to the minimum display brightness is greater than the negative operating voltage output by the power supply unit 2 when the brightness control factor corresponds to the maximum display brightness, so that the display effect of the display apparatus can be optimized to some extent. The specific correspondence relationship between the negative operating voltage and the brightness control factor is not limited in the present disclosure.

In some embodiments, the display driver module may further include: a gray scale control unit 3 and a gamma voltage output unit 4. The gray scale control unit 3 is configured to output a gray scale control signal to the source driving unit 1. The gamma voltage output unit 4 is configured to supply a gamma reference voltage group to the source driving unit 1, and the gamma reference voltage group includes a plurality of gamma reference voltages. The source driving unit 1 performs voltage division on the gamma reference voltage in the gamma reference voltage group according to the gray scale control signal to generate a data voltage corresponding to a gray scale, and outputs the data voltage to a data line.

As an alternative, the brightness control factor in the present disclosure is the gray scale control signal. As an exemplary embodiment, there are 256 gray scales, which are denoted as L0 to L255, where L0 corresponds to the minimum display brightness and L255 corresponds to the maximum display brightness. Correspondingly, the gray scale control unit 3 can output 256 different gray scale control signals, which are respectively denoted as GCS_L0 to GCS_L255. The correspondence relationship between the gray scale control signal, the voltage control signal, and the negative operating voltage is shown in Table 1.

TABLE 1

Correspondence table of gray scale control signal, voltage control signal and negative operating voltage

| gray scale control signal | voltage control signal | negative operating voltage (V) |
|---|---|---|
| GCS_L0~GCS_L15 | VCS_1 | −1 |
| GCS_L16~GCS_L31 | VCS_2 | −2 |
| GCS_L32~GCS_L63 | VCS_3 | −3 |
| GCS_L64~GCS_L127 | VCS_4 | −4 |
| GCS_L128~GCS_L255 | VCS_5 | −5 |

In the embodiment, the gray scale control signal may be divided according to the gray scales into five intervals: GCS_L0 to GCS_L15, GCS_L16 to GCS_L31, GCS_L32 to GCS_L63, and GCS_L64 to GCS_L127, and five different voltage control signals, namely, VCS_1, VCS_2, VCS_3, VCS_4 and VCS_5, are set correspondingly to the five intervals. Corresponding to the five different voltage control signals, the power supply unit 2 can output five different negative operating voltages, and the magnitude of each negative operating voltage may be set and adjusted as actually required.

Taking the gray scale L87 as an example, the gray scale control signal is GCS_L87, at this time, the source driving unit 1 determines that the voltage control signal corresponding to the gray scale control signal GCS_L87 is VCS_4 by looking up the table and outputs the determined voltage control signal to the power supply unit 2, and the power supply unit 2 outputs a negative operating voltage of −4 V to the cathode of the light emitting device OLED according to the received voltage control signal of VCS_4.

The above technical solution in which the gray scale control signal is divided into five intervals, five voltage control signals are set, and five different negative operating voltages are set is only illustrative, and does not intended to limit the technical solutions of the present disclosure. In the present disclosure, other implementation may also be adopted to achieve adjustment of the output negative operating voltage according to the gray scale control signal. For example, 256 voltage control signals and 256 different negative operating voltages may be set correspondingly to 256 gray scale control signals, and in this case, the brightness of the light emitting device OLED changes more evenly. Other implementations are not listed one by one here. It can be understood that the correspondence relationship between the gray scale control signal, the voltage control signal, and the negative operating voltage can be pre-stored in the display driver module and be accessed by the source driving unit 1 and the power supply unit 2. For example, the correspondence relationship between the gray scale control signal, the voltage control signal, the negative operating voltage may be stored in a memory in the display driver module, and the memory may be coupled to the source driving unit 1 and the power supply unit 2, respectively.

As an optional implementation, the brightness control factor in the present disclosure is a gamma reference voltage group. As an exemplary embodiment, there are seven overall brightness schemes of the display apparatus. Table 2 is a correspondence table of the gamma reference voltage group, the voltage control signal and the negative operating voltage, as shown below:

TABLE 2

Correspondence table of gamma reference voltage group, voltage control signal, and negative operating voltage

| gamma reference voltage group | voltage control signal | negative operating voltage (V) |
|---|---|---|
| GAMMA1 | VCS_7 | −7 |
| GAMMA2 | VCS_6 | −6 |
| GAMMA3 | VCS_5 | −5 |
| GAMMA4 | VCS_4 | −4 |
| GAMMA5 | VCS_3 | −3 |
| GAMMA6 | VCS_2 | −2 |
| GAMMA7 | VCS_1 | −1 |

In the embodiment, the gamma voltage output unit 4 may output seven different gamma reference voltage groups: GAMMA1 to GAMMA7, and the brightness performances corresponding to the seven gamma reference voltage groups are 100%, 85%, 70%, 55%, 40%, 25% and 10%, and seven different voltage control signals: VCS_1, VCS_2, VCS_3, VCS_4, VCS_5, VCS_6 and VCS_7 are set correspondingly to the seven gamma reference voltage groups. Corresponding to the seven different voltage control signals, the power supply unit 2 may output seven different negative operating voltages, and the magnitude of each negative operating voltage may be set and adjusted as actually required.

It should be noted that the "brightness performance" corresponding to the gamma reference voltage group in the present disclosure refers to a ratio between the brightness presented by the display apparatus when the source driving unit 1 outputs to each pixel unit in the display apparatus a data voltage for a gray scale of 255 according to the gamma reference voltage group (for different gamma reference voltage groups, the data voltages output by the source driving unit 1 are different in the case of a same gray scale), and the maximum brightness that can be achieved by the display apparatus.

Taking a case where the gamma reference voltage group outputted by the gamma voltage output unit 4 is GAMMA3 as an example, in this case, the source driving unit 1 determines that the voltage control signal corresponding to the gamma reference voltage group GAMMA3 is VCS_3 by looking up the table, and outputs VCS_3 to the power supply unit 2, and the power supply unit 2 outputs a negative operating voltage of −3V to the cathode of the light emitting device OLED according to the received voltage control signal of VCS_3.

It should be noted that, in the present disclosure, other implementation may also be adopted to achieve adjustment of the output negative operating voltage according to the gamma reference voltage group, which will not be listed one by one herein. In addition, the correspondence relationship between the gamma reference voltage group, the voltage control signal, and the negative operating voltage may be pre-stored in the display driver module and may be accessed by the source driving unit 1 and the power supply unit 2. For example, the correspondence relationship between the gamma reference voltage group, the voltage control signal, the negative operating voltage may be stored in a memory included in the display driver module, and the memory may be coupled to the source driving unit 1 and the power supply unit 2, respectively.

Figure 4:
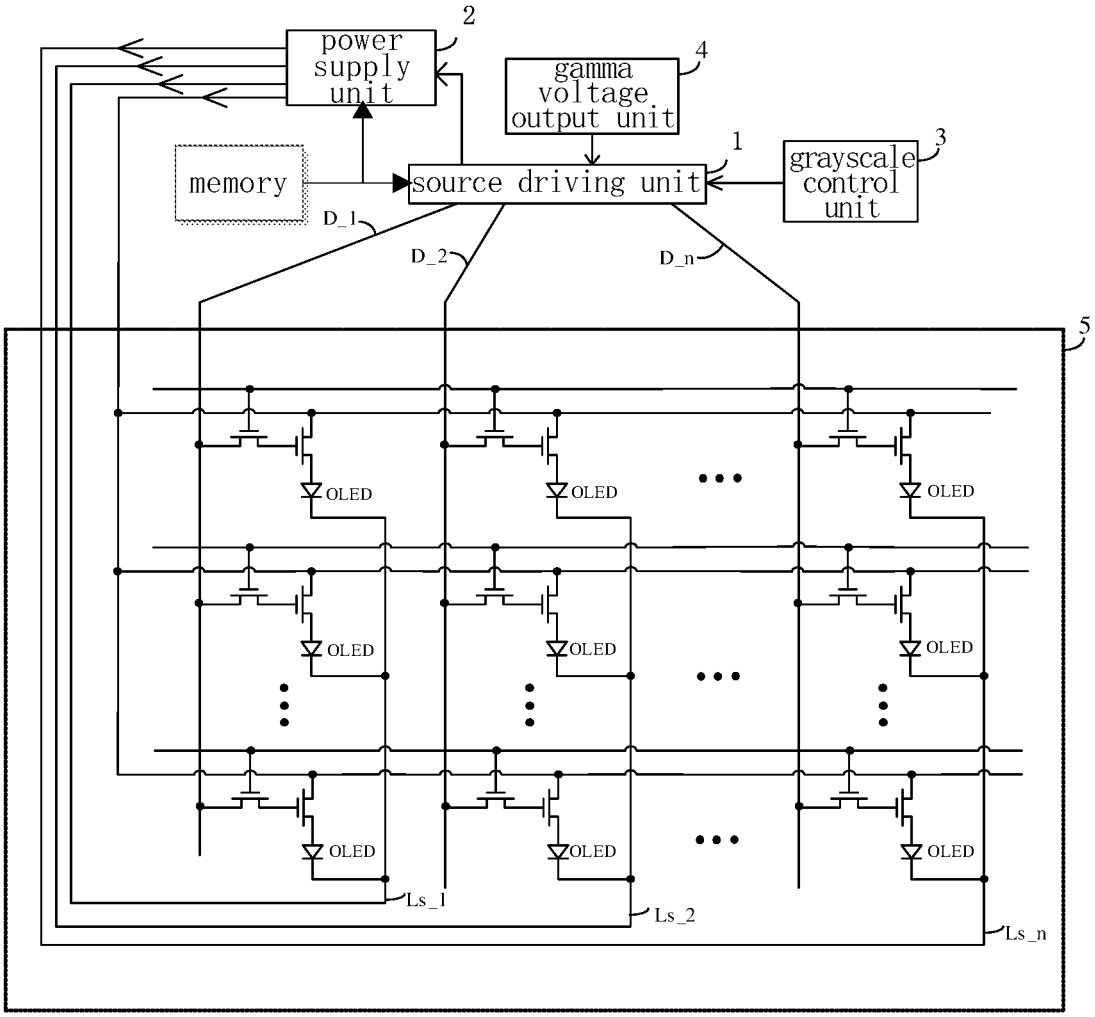
FIG. 4 is a schematic structural diagram of a display apparatus according to an embodiment of the present disclosure.

FIG. 4 is a schematic structural diagram of a display apparatus according to an embodiment of the present disclosure. As shown in FIG. 4, the display apparatus includes a display driver module, and the display driver module is the above display driver module. The specific description of the display driver module may refer to that in the foregoing embodiments, and details are not repeatedly described herein.

In an embodiment, the display apparatus further includes: a display substrate 5, a plurality of pixel regions are arranged in an array on the display substrate 5, and a pixel driving circuit and a light emitting device OLED are disposed in the pixel region. The pixel driving circuit is coupled to an anode of the light emitting device OLED, and a cathode of the light emitting device OLED is coupled to the power supply unit 2.

It should be noted that, the pixel driving circuit in the drawing having a 2T1C structure constituted by one switching transistor, one driving transistor DTFT, and one capacitor is only illustrative, the specific structure of the pixel driving circuit is not limited in the technical solutions of the present disclosure, and any pixel driving circuit may be applicable.

In the embodiment, the brightness control factor is a gray scale control signal, that is, the power supply unit 2 adjusts the negative operating voltage according to the gray scale of the data voltage generated by the source driving unit 1.

In the driving process of the display apparatus, display is often achieved by driving the pixel regions row by row. In this case, the source driving unit supplies data voltages to the pixel regions in the driven row through the data lines D_1, D_2, . . . , and D_n, and because the gray scales corresponding to the data voltages required for the pixel regions in the driven row may be different, it is necessary to separately control the cathode voltage of the light emitting device OLED in each pixel region in the driven row. In this case, the cathodes of the light emitting devices OLEDs in a same column may be coupled to the power supply unit 2 through a same signal line, and the cathodes of the light emitting devices OLEDs in different columns are coupled to the power supply unit 2 through different signal lines.

A case in which the display substrate 5 includes n columns of pixel regions is taken as an example, in this case, n signal lines Ls_1, Ls_2, . . . , and Ls_n for transferring negative operating voltages need to be arranged in the display substrate 5, and the n signal lines Ls_1, Ls_2, . . . , and Ls_n are coupled to the power supply unit 2 through a voltage distribution circuit (not shown). When driving one row of pixel regions, the power supply unit 2 generates corresponding negative operating voltages according to the gray scales of the data voltages corresponding to the respective pixel regions in the driven row, and outputs the negative operating voltages to the respective pixel regions through different signal lines.

In the embodiment, when the display apparatus performs image display, the light emitting device OLED displaying a high gray scale has a higher brightness, and the light emitting device OLED displaying a low gray scale has a darker brightness, so that the displayed image has an improved contrast and the display effect is improved.

It can be understood that the brightness and white balance of the display apparatus in the present disclosure can be adjusted before leaving the factory. That is to say, the physical brightness and the maximum screen brightness of the display apparatus are determined before leaving the factory, but the actual display brightness of the screen can be adjusted as needed during use.

Figure 5:
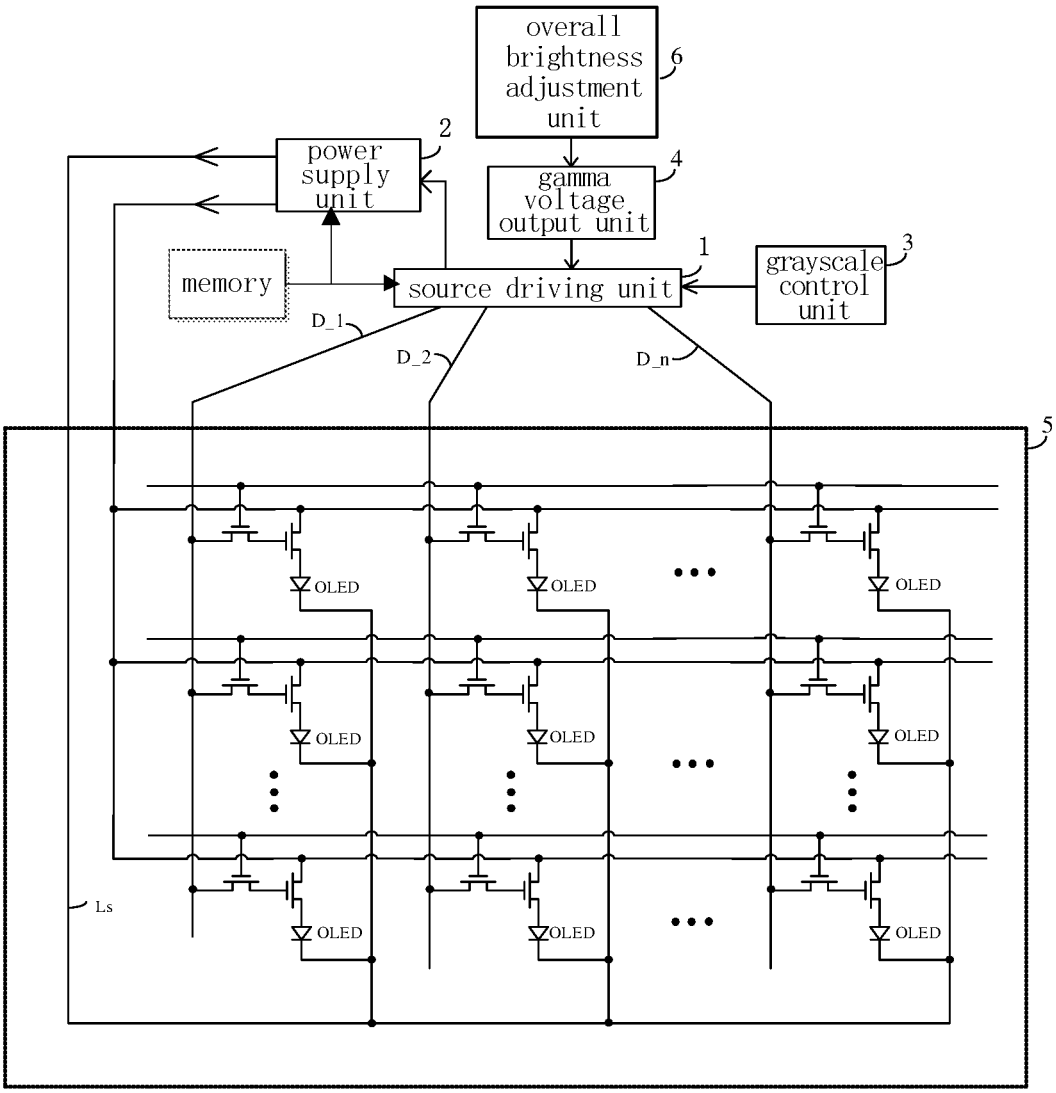
FIG. 5 is a schematic structural diagram of a display apparatus according to an embodiment of the present disclosure.

FIG. 5 is a schematic structural diagram of a display apparatus according to an embodiment of the present disclosure. As shown in FIG. 5, different from the display apparatus in the above embodiment, the brightness control factor in the embodiment is a gamma reference voltage group, that is, the power supply unit 2 adjusts the negative operating voltage according to the gamma reference voltage group supplied by the gamma voltage output unit 4.

As shown in FIG. 5, the display apparatus further includes: an overall brightness adjustment unit 6 configured to output a gamma voltage control signal to the gamma voltage output unit 4 according to user's operation, and the gamma voltage output unit 4 provides a corresponding gamma reference voltage group to the source driving unit 1 according to the gamma voltage control signal provided by the overall brightness adjustment unit 6, so as to control the overall display brightness of the display apparatus. It should be noted that the overall brightness adjustment unit 6 may be a physical adjustment component (for example, a physical button), or may be a virtual adjustment component (for example, a brightness adjustment slider displayed on a display panel).

In the embodiment, since the power supply unit 2 adjusts the negative operating voltage according to the gamma reference voltage group so as to adjust the overall brightness of the display apparatus, the cathodes of all the light emitting devices OLEDs on the display substrate 5 may be coupled to the power supply unit 2 through a same signal line Ls to reduce the number of the signal lines on the display substrate 5.

Compared with the related art, in the embodiment, by adjusting the overall brightness of the display screen, a higher brightness can be presented for a high brightness image, and a lower brightness can be presented for a low brightness image, so that the display effect is improved.

It should be noted that the display apparatus in the present disclosure may be an OLED display apparatus or a backlight in a liquid crystal display apparatus.

Figure 6:
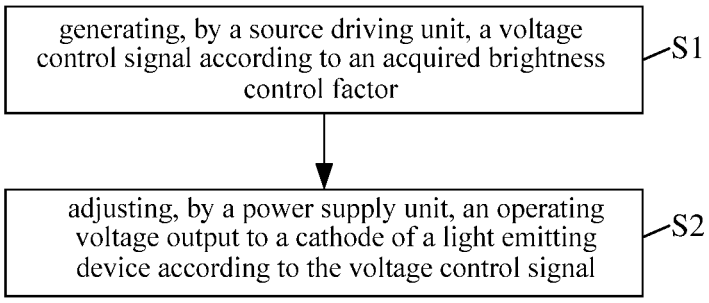
FIG. 6 is a flowchart of a voltage adjustment method according to an embodiment of the present disclosure.

FIG. 6 is a flowchart of a voltage adjustment method according to an embodiment of the present disclosure. As shown in FIG. 6, the voltage adjustment method is used to adjust a negative operating voltage output by a power supply unit to a cathode of a light emitting device, and the voltage adjustment method is based on the display driver module provided by the present disclosure. For the specific description of the display driver module, reference may be made to the foregoing contents, and details thereof are not repeatedly described herein. The voltage adjustment method includes steps S1 and S2.

At step S1, the source driving unit generates a voltage control signal according to an acquired brightness control factor.

In the embodiment, the brightness control factor may be a gray scale control signal provided by the gray scale control unit or a gamma reference voltage group provided by the gamma voltage output unit.

At step S2, the power supply unit adjusts an operating voltage output to a cathode of a light emitting device according to the voltage control signal.

The operating voltage decreases or remains unchanged as display brightness corresponding to the brightness control factor increases, and the operating voltage output by the power supply unit when the brightness control factor corresponds to the minimum display brightness is greater than the operating voltage output by the power supply unit when the brightness control factor corresponds to the maximum display brightness.

In some embodiments, the operating voltage decreases (i.e., strictly monotonically decreases) as the display brightness corresponding to the brightness control factor increases, and in this case, the brightness of the light emitting device changes more uniformly.

In the embodiment, the method further includes:

step S0: performing voltage division on the gamma reference voltage in the gamma reference voltage group provided by the gamma voltage output unit according to the gray scale control signal provided by the gray scale control unit to generate a data voltage and outputting the data voltage to a corresponding data line by the source driving unit.

It should be noted that, in the embodiment, the order in which step S0 is performed is not limited, that is, step S0 may be performed before step S1, after step S2, between steps S1 and S2, or at the same time with step S1 or S2, which are all within the protection scope of the present disclosure.

For the detailed description of the foregoing steps, reference may be made to the corresponding contents in the foregoing embodiments, and details are not described herein again.

In the embodiment, by correspondingly adjusting the operating voltage output to the cathode of the light emitting device, the display effect of the display apparatus can be effectively improved.

It could be understood that the above implementations are merely exemplary implementations employed for explaining the principles of the present disclosure, but the present disclosure is not limited thereto. Various modifications and improvements can be made by those skilled in the art without departing from the spirit and scope of the disclosure, and these modifications and improvements are also considered to fall within the protection scope of the present disclosure.

What is claimed is:

1. A display driver module, comprising:

a source driver, configured to generate a voltage control signal for each pixel region according to an acquired brightness control factor, the brightness control factor being a factor that affects display brightness of the pixel region only; and a power supply unit, configured to adjust an operating voltage output to a cathode of a light emitting device in each pixel region according to the voltage control signal; wherein the operating voltage decreases or maintains unchanged as display brightness corresponding to the brightness control factor increases, and the operating voltage output by the power supply unit in response to the brightness control factor corresponding to a minimum display brightness of the pixel region is greater than the operating voltage output by the power supply unit in response to the brightness control factor corresponding to a maximum display brightness of the pixel region.

2. The display driver module of claim 1, wherein the display brightness of the light emitting device is divided into a plurality of brightness intervals, and the operating voltage varies as the brightness interval to which the display brightness corresponding to the brightness control factor belongs varies.

3. The display driver module of claim 1, further comprising:

a gray scale controller, configured to output a gray scale control signal to the source driver; and a gamma voltage generator, configured to provide a gamma reference voltage group to the source driver, the gamma reference voltage group comprising a plurality of gamma reference voltages;

wherein the source driver performs voltage division on the gamma reference voltage in the gamma reference voltage group according to the gray scale control signal to generate a data voltage, and outputs the data voltage to a corresponding data line.

4. The display driver module of claim 3, wherein the brightness control factor is the gray scale control signal.

5. The display driver module of claim 3, wherein the brightness control factor is the gamma reference voltage group.

6. The display driver module of claim 4, further comprising: a memory for storing correspondence relationship between the gray scale control signal, the voltage control signal, and the operating voltage, wherein:

the gray scale controller is configured to output a gray scale control signal to the source driver according to a display gray scale;

the source driver is further configured to generate the voltage control signal according to the acquired gray scale control signal; and the power supply unit is configured to output an operating voltage according to the voltage control signal generated by the source driver.

7. The display driver module of claim 5, further comprising: a memory for storing correspondence relationship between the gamma reference voltage group, the voltage control signal, and the operating voltage, wherein:

the gamma voltage generator pre-stores a plurality of gamma reference voltage groups;

the source driver is further configured to generate the voltage control signal according to the acquired gamma reference voltage group; and the power supply unit is configured to output an operating voltage according to the voltage control signal generated by the source driver.

8. A display apparatus, comprising: the display driver module of claim 1.

9. A display apparatus, comprising: the display driver module of claim 4.

10. A display apparatus, comprising: the display driver module of claim 5.

11. The display apparatus of claim 9, further comprising: a display substrate having a plurality of pixel regions arranged in an array, wherein the pixel region is provided with a pixel driving circuit and a light emitting device, the pixel driving circuit being coupled to an anode of the light emitting device;

cathodes of the light emitting devices in a same column are coupled to the power supply unit through a same signal line, and cathodes of the light emitting devices in different columns are coupled to the power supply unit through different signal lines.

12. The display apparatus of claim 10, further comprising:

an overall brightness adjustment unit, configured to output a gamma voltage control signal to the gamma voltage generator according to an operation from a user;

wherein the gamma voltage generator is further configured to provide a corresponding gamma reference voltage group to the source driver according to the gamma voltage control signal provided by the overall brightness adjustment unit.

13. The display apparatus of claim 12, further comprising: a display substrate having a plurality of pixel regions arranged in an array, wherein the pixel region is provided with a pixel driving circuit and a light emitting device, and the pixel driving circuit is coupled to an anode of the light emitting device; and cathodes of the light emitting devices in a same column are coupled to the power supply unit through a same signal line, and cathodes of the light emitting devices in different columns are coupled to the power supply unit through a same signal line.

14. A voltage adjustment method, comprising:

generating, by a source driver, a voltage control signal for each pixel region according to an acquired brightness control factor, the brightness control factor being a factor that affects display brightness of the pixel region only; and adjusting, by a power supply unit, an operating voltage output to a cathode of a light emitting device in each pixel region according to the voltage control signal; wherein the operating voltage decreases or keeps unchanged as display brightness corresponding to the brightness control factor increases, and the operating voltage output by the power supply unit in response to the brightness control factor corresponding to a minimum display brightness of the pixel region is greater than the operating voltage output by the power supply unit in response to the brightness control factor corresponding to a maximum display brightness of the pixel region.

15. The voltage adjustment method of claim 14, wherein the display brightness of the light emitting device is divided into a plurality of brightness intervals, and the operating voltage varies as the brightness interval to which the display brightness corresponding to the brightness control factor belongs varies.

16. The voltage adjustment method of claim 14, further comprising:

performing voltage division on a gamma reference voltage in a gamma reference voltage group provided by a gamma voltage generator according to a gray scale control signal provided by a gray scale controller to generate a data voltage and outputting the data voltage to a corresponding data line by the source driver.

17. The voltage adjustment method of claim 14, wherein the brightness control factor is a gray scale control signal.

18. The voltage adjustment method of claim 14, wherein the brightness control factor is a gamma reference voltage group.

19. The voltage adjustment method of claim 17, comprising:

outputting, by the gray scale controller, the gray scale control signal to the source driver according to a display gray scale;

generating, by the source driver, the voltage control signal according to the acquired gray scale control signal; and outputting, by the power supply unit, the operating voltage according to the voltage control signal generated by the source driver, wherein correspondence relationship between the gray scale control signal, the voltage control signal, and the operating voltage is pre-stored in a memory.

20. The voltage adjustment method of claim 18, comprising:

pre-storing, by a gamma voltage generator, a plurality of gamma reference voltage groups;

generating, by the source driver, the voltage control signal according to an acquired gamma reference voltage group;

outputting, by the power supply unit, the operating voltage according to the voltage control signal generated by the source driver, wherein correspondence relationship between the gamma reference voltage group, the voltage control signal, and the operating voltage is pre-stored in a memory.

* * * * *